United States Patent [19]

Kelly

[11] Patent Number: 4,716,415

[45] Date of Patent: Dec. 29, 1987

[54] DUAL POLARIZATION FLAT PLATE ANTENNA

[76] Inventor: Kenneth C. Kelly, 9360 Shoshone Ave., Northridge, Calif. 91325

[21] Appl. No.: 678,891

[22] Filed: Dec. 6, 1984

[51] Int. Cl.[4] ..... H01Q 13/10

[52] U.S. Cl. ..... 343/771; 343/770

[58] Field of Search ..... 343/767-771, 343/746, 708, 776

[56] References Cited

U.S. PATENT DOCUMENTS

| | | | |
|---|---|---|---|
| 3,281,851 | 10/1966 | Goebels | 343/771 |
| 3,340,534 | 9/1967 | Fee | 343/771 |
| 3,599,216 | 8/1971 | Paine et al. | 343/771 |
| 3,701,162 | 10/1972 | Seaton | 343/771 |

*Primary Examiner*—William L. Sikes
*Assistant Examiner*—Michael C. Wimer
*Attorney, Agent, or Firm*—Polster, Polster and Lucchesi

[57] ABSTRACT

A flat plate array is provided which permits generation of two independent beams from a single slotted waveguide antenna. The two beams are coincident in space, but are of two different linear polarizations, those polarizations being orthogonal, i.e., at right angles to each other. In the preferred embodiment, a plurality of slots are provided in a flat top plate of a waveguide cavity. The slots are located in rows and columns with a predetermined spacing between pairs of slots positioned in the respective rows and columns. Each beam is associated with its own input/output port and either the rows or columns of slots of the array. Coupling the two ports with a suitable power splitter and phase shifter permits the antenna to produce a single beam with any elliptical polarization, any linear polarization, right circular polarization, or left circular polarization, plus a second coincident beam with polarization characteristics "orthogonal" to the first, for example, right circular polarization and left circular polarization.

17 Claims, 9 Drawing Figures

FIG. 6.
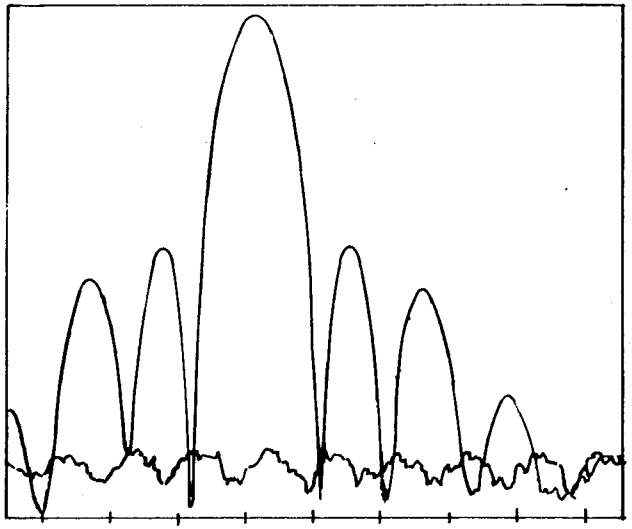
FIG. 5.
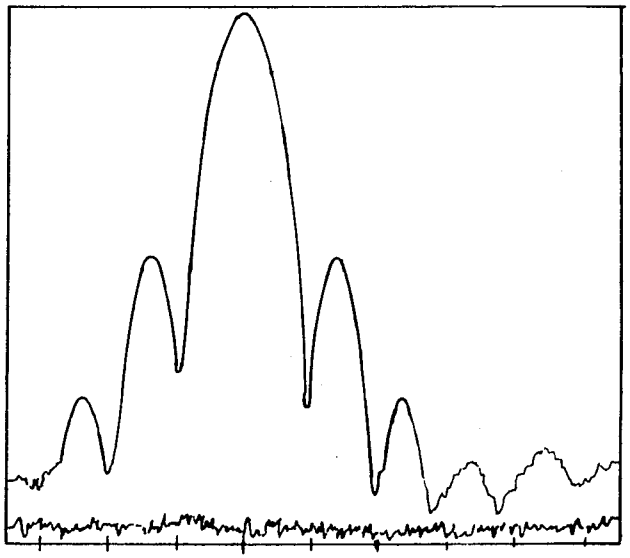
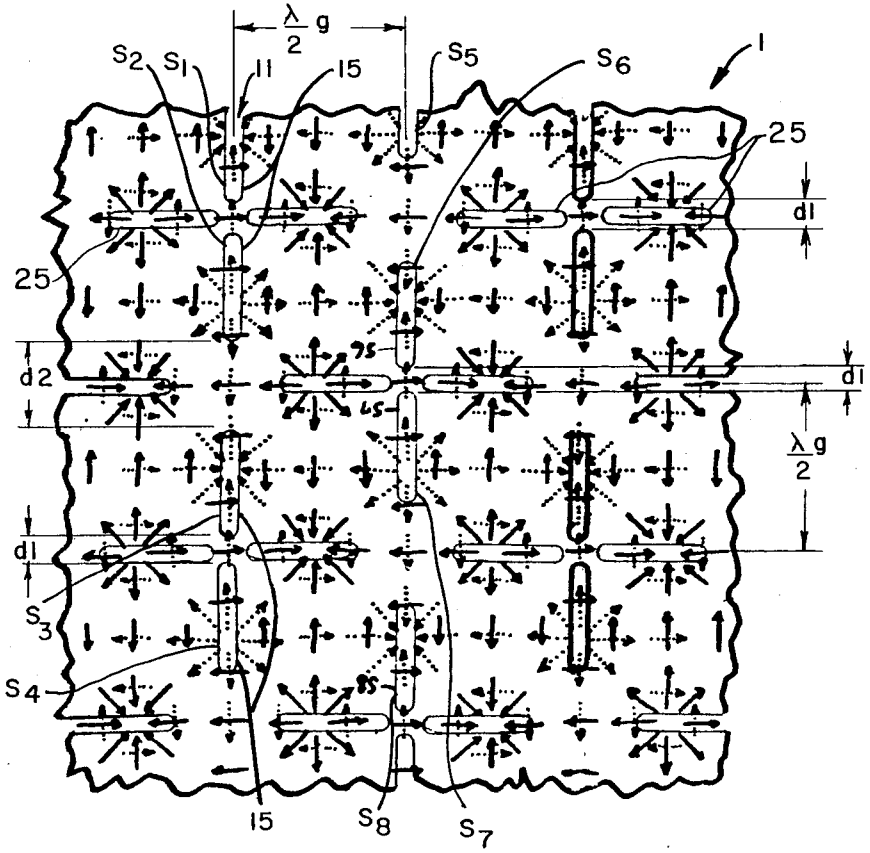
FIG. 4.

DUAL POLARIZATION FLAT PLATE ANTENNA

BACKGROUND OF THE INVENTION

This invention relates to a slot array radiator, and more particularly, to a dual input/output port, dual polarization flat plate slot array antenna.

There long has been a need for an efficient, compact, flat antenna capable of generating coincident broadside beams with orthogonal polarizations, or a single beam whose polarization may be fully adjusted. It is well known that radar targets, for example, reflect different amounts of energy back to a radar receiver depending upon the polarization of the incident beam. The ability to readily change the polarizations from a single slotted planar array antenna greatly increases the capability of a radar detector. A radar detector employing the antenna of this invention is able to make the desired polarization change easily during target detection.

Slotted waveguide flat plate antennas are well known in the art. Such antennas also have been proposed for dual polarization and arbitrary polarization modes. In the past, the designs proposed have been handicapped by a number of design deficiencies. Previous to my invention, offered designs required the slots of such a flat plate array antenna to be positioned one waveguide wavelength apart. With such spacing, prior art antennas had low efficiencies for broadside beams because of the large gaps in the aperture, and so called "grating" lobes or "second order" beams resulted. The antenna disclosed hereinafter permits the slots to be placed one-half waveguide wavelength apart, thereby "filling" the aperture and eliminating grating lobes and obtaining higher aperture efficiency for broadside beams. In addition, as disclosed hereinafter, size of the antenna of this invention may be varied merely by altering the waveguide mode number, the numbers of rows and columns of slots, and adjusting the size of the top plate and the waveguide cavity. The prior art references of which I am aware include U.S. Pat. No. 3,599,216 ('216), which shows a circular polarized planar array antenna having alternately displaced transverse slots over virtual walls for one component, and a set of conventional shunt slots between virtual walls for the other component of a circularized polarized beam. The '216 patent, however, deals with a single port, single beam, fixed single circular polarization slotted waveguide broadside pencil beam antenna.

U.S. Pat. Nos. 3,623,112 and 4,063,248 and 4,353,072 all describe radiating elements which involve a combination of waveguide radiators and dipole radiators, the latter having coax and/or stripline feeding which limits RF power handling. Each functions in a manner substantially different from the invention disclosed hereinafter.

U.S. Pat. Nos. 2,982,960 and 3,281,851 and 3,348,227 and 3,503,073 show approaches that require full waveguide wavelength spacing between at least some of the radiating slots to achieve a broadside beam. That type of construction is a flaw if off-broadside second order beams are to be suppressed without using heavy and lossy dielectric loading in the waveguides.

U.S. Pat. Nos. 3,382,501 and 3,340,534 show a single port, single sense of circular polarization radiators formed by adding wire loops external to slots or open ended waveguides.

U.S. Pat. No. 4,197,541 shows a square coaxial transmission line radiator with coaxial line network elements which make the device unsuitable for use at millimeter wavelengths.

U.S. Pat. No. 4,266,228 shows ordinary cross slots on rectangular waveguides, which, as previously indicated, requires that the slot spacing be one waveguide wavelength apart in order to produce a broadside beam and would have second order beams under that condition.

The invention disclosed hereinafter provides a means to obtain two independent beams from a single slotted waveguide antenna. It does so with a compact "flat plate" design which is simple to manufacture. As will be appreciated by those skilled in the art, the fact that all of the slots are in a single slotted plate allows the use of precise photolithographic techniques, especially useful with millimeter wavelengths designs.

One of the objects of this invention is to provide a dual polarization slot antenna array with an independent terminal for each polarization.

Another object of this invention is to provide a dual polarization slot array antenna in which the slots of the radiating element may be positioned one-half waveguide wavelength apart, yet have the slots radiate in phase.

Another object of this invention is to provide a simplified antenna structure.

Another object of this invention is to provide an antenna structure which permit elliptical polarizations, linear polarizations, and circular polarizations from a single antenna structure.

Another object of this invention is to provide a single antenna structure which permits transmission on right circular polarization and receive on left circular polarization, or transmission on any desired polarization and receive on any different polarization.

Another object of this invention is to provide ease of fabrication for flat plate antennas regardless of how high a microwave frequency of operation is required.

Another object of this invention is to provide an antenna with lower resistive losses than obtained in flat plate antennas formed of a multiplicity of individual rectangular waveguides, each rectangular waveguide having slot radiators.

Another object of this invention is to allow the transmission of high microwave power levels without RF power breakdown, particularly for millimeter wavelengths.

Another object of this invention is to provide an antenna for passive "listen-only" systems for analysis of the polarization characteristics of received signals.

Other objects of this invention will be apparent to those skilled in the art in light of the following description and accompanying drawings.

SUMMARY OF THE INVENTION

In accordance with this invention, generally stated, a dual polarization flat plate antenna is provided which permits generation of two independent beams from a single slotted antenna area. The two beams are coincident in space, but of two different polarizations. Two linear polarizations are provided at right angles to one another. That is to say, the polarizations are orthogonal. In the preferred embodiment, a first set of slots are provided in respective rows and columns, all slots being parallel to one another. That first set forms a broadside antenna beam as a result of coupling between that first set of slots and one waveguide mode in the region under the slotted plate. A second set of slots, all perpendicular to the first set of slots, form a second broadside beam as a result of those slots coupling to a second waveguide mode. The two coincident beams are differentiated by their polarizations and by each beam having its own terminal or input/output port. Since all slot spacings, in either set, are well under a free space wavelength, second order beams and grating lobes are eliminated.

BRIEF DESCRIPTION OF THE DRAWING

In the drawings,

FIG. 4 is an enlarged diagrammatic view, partly broken away, taken about the area 4—4 of FIG. 1;

FIG. 5 is one illustrative measurement of an E-plane pattern obtained with the antenna of this invention; and FIG. 6 is one illustrative measurement of an H-plane pattern obtained with the antenna of this invention.

DESCRIPTION OF THE PREFERRED EMBODIMENT

Figure 1:
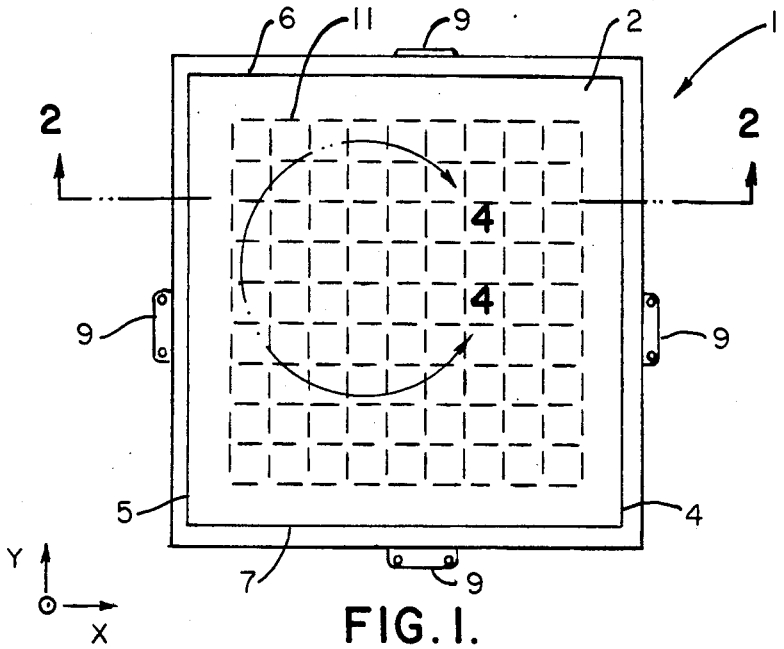
FIG. 1 is top plan view of one illustrative embodiment of the slot array antenna of this invention.

Referring now to the FIG. 1, reference numeral 1 indicates one illustrative embodiment of array of this invention. Array 1 includes a top plate 2, a bottom plate 3, a first pair of oppositely opposed side walls 4 and 5, respectively, and a second pair of oppositely opposed side walls 6 and 7.

The top, bottom and sides define a cavity 8 which is designed to support the rectangular waveguide mode $TE_{P,N}$ propagating left-right in FIG. 1, and a $TE_{Q,N}$ mode propagating up-down in FIG. 1. The notations "P" and "Q" are non-zero integers and may be equal or unequal. In the symbols $TE_{P,N}$ and $TE_{Q,N}$, TE refers to the electric field of the mode, P, the mode number, represents the number of maxima of the electric field along one direction, and N represents the number of maxima along a direction perpendicular to the one direction, and Q, the mode number, represents the number of maxima of the electric field along a predetermined direction perpendicular to the one direction and N represents the number of maxima along a direction perpendicular to the predetermine direction. For the purpose of this specification and the embodiment illustrated, "P" and "Q" were arbitrarily selected as an integer 10. Those skilled in the art will recognize that the principles described hereinafter apply regardless of the integer chosen for "P" and "Q" and that the size of the antenna and the number of radiating slots will change with changes in "P" and/or "Q". The references to rectangular waveguide modes correspond to the mode descriptions contained in the book entitled *Waveguide Handbook*, edited by N. Marcuvitz, published by McGraw-Hill Book Company, Inc., 1951, pages 55–66. The invention would work as well if $TE_{P,N}$ and $TE_{Q,N}$ modes were used with "N" being an integer other than zero but N=0 will be used throughout the description hereafter.

Figure 3:
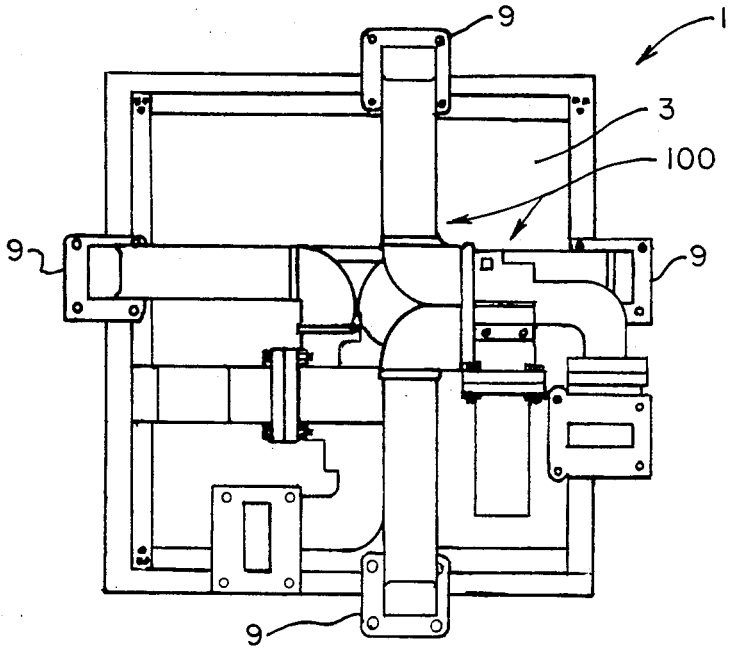
FIG. 3 is a bottom plan view of the array shown in FIG. 1.

Each of the sides 4, 5, 6, and 7 have a waveguide connection indicated generally by the numeral 9. The connections 9 are utilized to attach the antenna to a suitable feed network, generally indicated by the reference numeral 100 in FIG. 3. Those skilled in the art will recognize that a wide variety of waveguide, coax, or stipline feed networks may be employed with the array of this invention.

Figure 2:
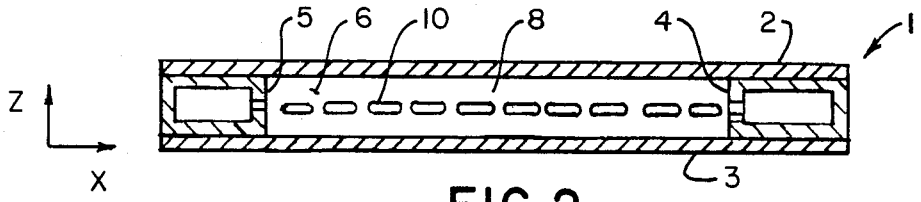
FIG. 2 is a sectional view taken along the line 2—2 of FIG. 1.

While described as "sides", as shown in FIG. 2 each of the sides 4, 5, 6, and 7 are themselves rectangular waveguides. The sides or waveguides 4 and 5 are shown in cross section in FIG. 2, while the side or waveguide 6 is shown in side view. The waveguides may be mounted as shown in FIG. 2, or rotated 90°. Waveguide 6 has a plurality of feed slots 10 formed in it. The number of feed slots 10 in each of the sides 4, 5, 6, and 7 correspond to the value of "P" for sides 4 and 5, and to "Q" for sides 6 and 7. For the purpose of this description, there are ten slots in each "side". The top plate 2 has a plurality of radiating slots 11 formed in it.

The length dimension of the cavity 8 is a constant for a given microwave frequency of operation. In the preferred embodiment, the cavity 8 size is related to the values of P and Q. If the bottom wall or floor of the cavity is arbitrarily taken to be the starting measuring point and "N" is zero, then the distance to the top of the cavity 8 must be well under one-half of a free space wavelength, λ, at the microwave frequency of interest. Referring to FIG. 1, if equal spacing between the radiating slots 11 for each of the two beams is desired, then the left-right or X dimension of the cavity is chosen to be $Q\lambda/\sqrt{2}$ and the up-down or Y dimension is chosen as $P\lambda/\sqrt{2}$. Equal X direction and Y direction spacing is not a requirement for array operation. Ten slots are visible in the XZ plane of FIG. 2, and there are a like number of slots not visible in FIG. 2 in the side 7 end of the cavity and facing the visible set. As previously indicated, P and Q may be arbitrarily chosen. There is a similar set of feed slots in the sides 5 and 4. The P plus P slots of the sides 4 and 5 are feed slots to excite the $TE_{P,O}$ rectangular waveguide mode when the slots are properly excited. For purposes of this specification, the $TE_{P,O}$ mode is chosen to propagate in the plus/minus X direction of a conventional cartesian coordinate system, sometimes referred hereinafter as the X-$TE_{P,O}$ to indicate propagation direction, referenced with respect to FIG. 1. As indicated, there are Q slots in each of the rectangular feed guides 6 and 7. These Q plus Q slots are feed slots to excite the $TE_{Q,O}$ mode which propagates in the plus/minus Y direction of a conventional cartesian coordinate system, sometimes referred to hereinafter as the Y-$TE_{Q,O}$ mode.

The essence of this invention is the discovery of a means to independently excite both the $TE_{P,N}$ waveguide mode propagating in the X direction, and the $TE_{Q,N}$ waveguide mode propagating in the Y direction, then being able to have one set of slots couple only to one mode and a second set of slots couple only to the other mode.

The means for exciting the modes has already been partially described. There are a number of extant methods for exciting the needed modes, known in the art, and a detailed description is not repeated here for description simplicity. FIG. 4 shows a few of the radiating slots 11 in the top plate 2. The electric currents in the inside surface of the top plate 2 are shown as a series of dotted lines with arrow points for the $T_{Q,O}$ mode and a series of solid lines with arrow points for the $T_{P,O}$ mode in FIG. 4. The arrow points show the instantaneous directions of currents. For the first embodiment to be described, each plurality of slots 15, i.e., each in-line group of radiating slots with their long dimension parallel to the Y direction, shall be excited by the $TE_{P,O}$ mode which propagates in the plus/minus X direction. If slots S1, S2, S3 and S4 were equally spaced from each other, each of those slots would intercept $TE_{P,O}$ mode solid line currents with one end of the slot interrupting currents in one direction while the other end of the slot interrupts equal magnitude currents flowing in the opposite direction. Under those conditions there is no net excitation of the slots.

In fact, slots S1 and S2 are positioned close to each other with their ends a distance D1 apart so that slots S1 and S2 intercept more of the solid line currents directed to the right in FIG. 4. Slots S3 and S4 are also moved to make their ends D1 apart so that they too intercept more right-directed current than current flowing to the left. The adjacent ends of S2 and S3 thus become far apart, at a distance of D2. Slots S5 through S8 are one-half a waveguide wavelength away from S1 through S4 and thus the waves there are $\pi$ radians or 180 degrees out of phase with the waves at the first location.

Since all radiating slots must be in phase to create the desired broadside beam, the displacements of slots S5 through S8 are opposite the displacements of S1 through S4 in order to have all slots in phase. Note that by moving the first two slots S5 and S6 away from each other, those slots are moved into the domain of the right directed solid line currents thus making their radiation in phase with S1 and S2. Similarly for S7 and S8. Now, the smaller D1 spacing is between the central two slots. This process is carried out over the entire aperture to cause all radiating slots to be in phase despite the half waveguide wavelength spacing of slots in the propagation direction. This technique was employed in the '216 patent discussed above.

It is the discovery of the technique for having a second mode orthogonal to the first and yet selectively avoid coupling to that second mode that is the essence of this invention.

The $TE_{Q,O}$ mode propagating in the Y direction causes the dotted line currents on the inside of the top plate 2 of FIG. 4. In order for a slot to be excited and radiate, there must be a component of current flow perpendicular to the long dimension of the slot. Inspection of FIG. 4 shows that the dotted line currents of the Y-$TE_{Q,O}$ mode are all parallel to the long dimension of slots S1 and S8 and all other slots of slot set 15. So, the $TE_{Q,O}$ waveguide mode does not couple to any of the vertical slots of the slot set 15.

Excitation of a horizontal slot set 25 by the currents of the $TE_{Q,O}$ mode is accomplished in exactly the manner described for the vertical slots, except that it is the $TE_{Q,O}$ mode that is exciting the slot set 25. The alternating spacing of the horizontal slots so as to always interrupt the upward directed currents of the $TE_{Q,O}$ mode puts all of the horizontal slots' radiation in phase by the same mechanism described for the other set of slots.

As thus described, it may be seen that the slot set 15 is arranged in a plurality of "P−1" rows and "Q" columns in which the slots are arranged vertically, in which the slot set 25 is arranged in a plurality of "P" rows and "Q−1" columns in which the slots are arranged horizontally, referenced to FIGS. 1 and 4. Individual ones of pairs of slots of the slot sets 15 and 25 are separated by the distance D1, which pairs of the slots of the sets 15 and 25 are separated by the distance D2.

Figure 4A:
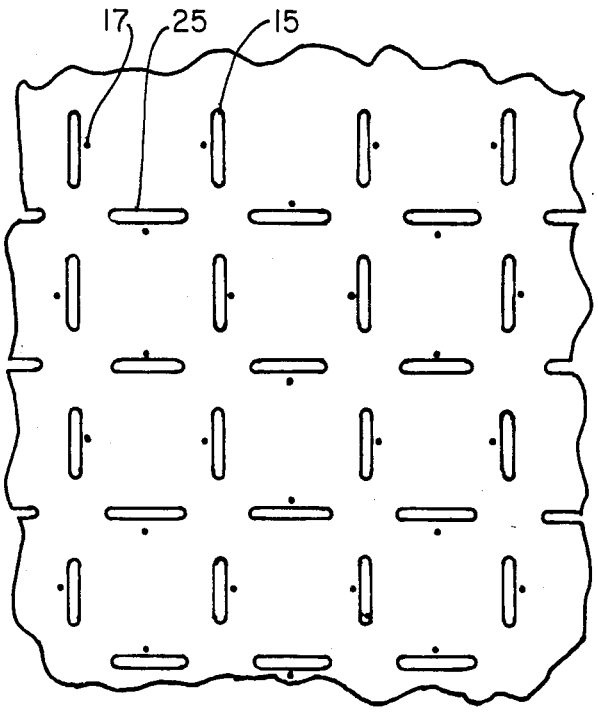
FIG. 4A is an enlarged diagrammatic view, partly broken away, corresponding to FIG. 4, but illustrating a second embodiment of this invention.
Figure 4C:
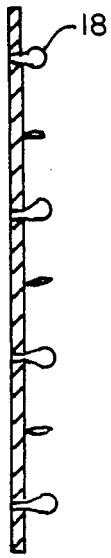
FIG. 4C is a sectional view partly broken away, taken along the line C—C of FIG. 4B.

FIG. 4A shows a second embodiment in which all of the slots are equally spaced from each other, unlike the situation in FIG. 4. As explained above, the slots won't couple when the slots are uniformly spaced because equal and opposite currents are interrupted by each slot for one mode, and the slots are parallel to the currents for the other mode. In FIG. 4A, a plurality of probes or posts 17 are added to each slot to perturb the fields in a manner familiar to those skilled in the art. Now, the vertically directed slots will couple only to the Y-$TE_{Q,N}$ mode and the horizontally directed slots couple only to the X-$TE_{P,N}$ mode. This is a reversal of the situation described for FIG. 4. The probes 17 are very slender posts attached only to the top plate 2 and projecting into the waveguide perpendicular to the top plate 2, and of a length to obtain the desired coupling of energy. The alteration of the side on which the probe is placed makes all slots of a given set radiate in phase. Other types of perturbing elements can be used instead of the slender cylindrical posts.

Alternatively, the perturbing posts can be attached only to the bottom plate 3 and protrude into the waveguide at the center of the length of each slot but alternating their offset from the slots in the same manner as indicated in FIG. 4A.

In either case, the probes or posts 17 couple only one set of slots to only one of the modes because the probes are located at an E-field zero, or virtual wall, of one of the modes and at the E-field maxima for that mode which gets coupled to one set of slots.

Figure 4B:
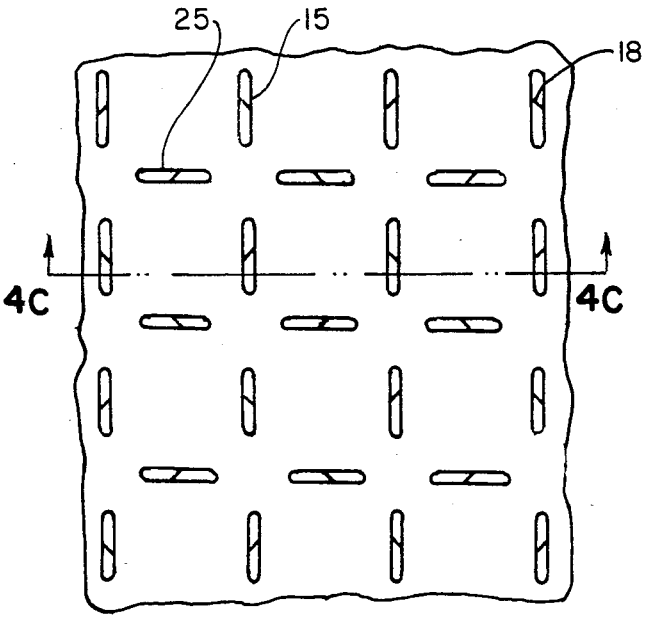
FIG. 4B is an enlarged diagrammatic view, partly broken away, corresponding to FIG. 4, but illustrating a third embodiment of this invention.

Finally, FIG. 4B shows another embodiment in which the slots are all equally spaced as in FIG. 4A. In the embodiment of FIG. 4B the coupling of the slots is accomplished by magnetic field coupling loops 18, instead of electric field probes or posts 17. The slots are made to be in phase by alternating the connection points of the coupling loops as shown in FIG. 4B and the side view of FIG. 4B shown in FIG. 4C.

In exciting the modes in the cavity 8, the opposing sets of feed slots in the cavity are joined by one magic T for one mode, and the other opposing set of feed slots adjoined by a second magic T. The unused port of each magic T has a short circuit so positioned as to create a short circuit at the "side walls" of the orthogonal mode.

Having used WR-90 waveguide in the slotted feed lines for convenience, it follows that a 1.8 inch waveguide wavelength was required to operate the 9 inch wide cavity in the TE mode in the preferred embodiment of this invention. Those figures lead to a theoretical operating frequency of 9273 MHz.

FIG. 5 is a measured E-plane pattern via the correct port for that polarization. The noise level trace results when the test detector is placed in the port for the orthogonal polarization, all other factors being unchanged. Approximately 30 dB isolation was obtained, but the exact value was unknown because the lower trace is in the noise level.

FIG. 6 is the H-plane pattern that goes with the E-plane pattern of FIG. 5. The near noise level trace results when the incident polarization is rotated 90°, all other factors remaining unchanged.

Unlike the various dual polarization antennas based upon the use of radial waveguides, the rectangular waveguide design of the present invention permits placement of elements one-half waveguide wavelength apart in the mode propagation direction, instead of a full wavelength apart, while permitting attainment of truly in phase radiation from all slots. The filled aperture of this rectangular waveguide design gives markedly improved aperture efficiency by eliminating second order beams. Those skilled in the art will appreciate that varying the amount of slot offsets from the lines of zero current allows for aperture tapering in the E-plane. Presently known radial waveguide slot antennas do not provide adequate means for varying the coupling between the waveguide and the exterior.

An alternative configuration for exciting the two orthogonal modes in the waveguides uses a single row of slots in the bottom of the cavity to excite the Y-$TE_{P,O}$ mode and a second single row of slots, at right angles to the first row, to excite the X-$TE_{Q,O}$ mode in the waveguide. This method requires that the configuration of the cavity walls in the XZ plane, the YZ plane, the plane $Y=(P)(\lambda/\sqrt{2})$ and in the plane $X=(Q)(\lambda/\sqrt{2})$ be such that those walls present a short circuit to the mode propagating parallel to any of those walls, and present an open circuit the mode propagating perpendicular to any of those walls. One method for achieving such characteristic for the walls is to use slots in a network identical to that described above for exciting the X-$TE_{P,O}$ and X-$TE_{Q,O}$ modes. In this later case, however, both ports of the magic T are shorted, with the shorts positioned to obtain the required zero and infinite impedence conditions at the side and end walls.

As thus shown and described, an orthogonal dual linear polarization array has a port associated with each polarization, and the linear polarizations are orthogonal. By combining the two ports through a suitable power divider and phase shifter network, any linear, elliptical or any circular polarization is obtained readily with complete variability to any point on the polarization sphere. By connecting the two ports via 90° phase shift 3 dB coupler, the antenna becomes an orthogonal dual circular polarization antenna, LHCP and RHCP.

Antenna size may be increased by increasing the mode index from $TE_{10,O}$ to $TE_{P,O}$ with P as large as desired. Conversely, the antenna size may be reduced by making P smaller than 10. Furthermore, the array need not be square. The array can be made rectangular by utilizing a $TE_{P,O}$ mode in one direction, and a $TE_{Q,O}$ mode in the orthogonal direction, P and Q being unequal non-zero integers.

Numerous variations, within the scope of the appended claims, will be apparent to those skilled in the art in light of the foregoing description and accompanying drawings. As indicated, the size and shape of the array may be varied in other embodiments of this invention. While certain design criteria are indicated as preferred, other criteria may be utilized if desired. Materials utilized in constructing the various components of the array 1 may be varied in embodiments of this invention. The array may be used with a great number of other associated circuits in addition to those described above. These variations are merely illustrative.

Having thus described the invention, what is claimed and desired to be secured by Letters Patent is:

1. A linearly polarized antenna for producing two coincident broadside beams with said beams having their polarizations orthogonal, comprising:

a top plate;

a bottom plate delimiting with said top plate a cavity in which a first higher order rectangular waveguide mode having a mode number P propagates in a first direction in the cavity, and a second and independent higher order rectangular waveguide mode having a mode number Q propagates in a second direction in the cavity, said first direction being orthogonal to said second direction, said top plate having a first set of radiating slots through it, all slots of said first set being parallel to a Y-axis of a cartesian coordinate system and arranged in P—1 rows of alternatingly staggered parallel radiating slots and Q columns of colinear radiating slots, and a second set of radiating slots, all slots of said second set being parallel to an X-axis of a cartesian coordinate system and arranged in P rows of colinear radiating slots and Q—1 columns of alternately staggered parallel radiating slots, the slots of said first and second sets having respective first and second longitudinal axes, the longitudinal axes of said first and second sets being perpendicular to one another.

2. The antenna of claim 1 wherein the modes have electric fields having zero magnitude at a plurality of locations in the cavity, said locations being virtual walls of the waveguide modes, wherein the average spacing between the center of the slots in rows of colinear slots of the first set of radiating slots is equal to the spacing between the virtual walls of the waveguide modes and the spacing between the rows is one-half a waveguide wavelength.

3. The antenna of claim 1 wherein the first waveguide mode is identified by the symbol $TE_{P,N}$ where TE refers to the electric field of the mode, P, the mode number, represents the number of maxima of the electric field along one direction, and N represents the number of maxima along a direction perpendicular to said one direction, and said second waveguide mode is identified by the symbol $TE_{Q,N}$ where Q, the mode number, represents the number of maxima of the electric field along a predetermined direction perpendicular to said one direction, and N represents the number of maxima along a direction perpendicular to said predetermined direction, further including at least one side wall, said side wall including means for producing excitation in said cavity for the $TE_{P,N}$, and $TE_{Q,N}$ modes.

4. The antenna of claim 1 wherein the first waveguide mode is identified by the symbol $TE_{P,N}$ where TE refers to the electric field of the mode, P, the mode number, represents the number of maxima of the electric field along one direction, and N represents the number of maxima along a direction perpendicular to said one direction, and said second waveguide mode is identified by the symbol $TE_{Q,N}$ where Q, the mode number, represents the number of maxima of the electric field along a predetermined direction perpendicular to said one direction, and N represents the number of maxima along a direction perpendicular to said predetermined direction, further including a plurality of conducting posts positioned between said top and bottom plates at predetermined positions based on the propagation properties of the $TE_{P,N}$ and the $TE_{Q,N}$ modes.

5. A dual polarization flat plate array, comprising:

a top plate;

a bottom palte; and at least first and second side walls operatively connected to said top and said bottom plate so as to define a cavity therebetween, said first side wall having a first predetermined number of slots disposed therein to excite an electromagnetic wave mode to propagate perpendicularly with respect to the first side wall across the cavity, said second side wall having a second predetermined number of slots therein to excite an electromagnetic wave mode to propagate perpendicularly with respect to the second side wall across the cavity, the first and second walls being disposed such that their respective electromagnetic wave modes are orthogonal, said top plate having a plurality of slots formed in it, said slots being arranged in a plurality of generally parallel rows and columns, each of said generally parallel rows and columns having respective alignment axes, each of said rows having first and second ones of said slots defining a slot pair, said slot pair having a first spacing between them, a second spacing between succeeding ones of said slot pairs; first and second ones of said slots of said columns defining a slot pair, said slot pair said columns having a first spacing between them a second spacing between successive ones of said slot pairs in said columns, successive ones of said parallel rows having a staggered relationship with respect to one another, successive ones of said parallel columns having a staggered relationship with respect to one another, the slots of said rows and the slots of said columns being positioned so that the axes of the rows and columns cross one another perpendicularly outside all slots along said first spacing, said rows of slots being disposed so as to couple only with the electromagnetic wave mode associated with the first side wall and the columns of slots being disposed so as to couple only with the electromagnetic wave mode associated with the second side wall.

6. The array of claim 5 wherein the electromagnetic wave mode associated with the first side wall has an electric field with a predetermined number Q of maxima across the cavity perpedicular to the first side wall, and the electromagnetic wave mode associated with the second side wall has an electric field with a predetermined number P of maxima across the cavity perpendicular to the second side wall, and said slots are arranged in P rows and Q columns, P and Q having different integer values.

7. The array of claim 6 wherein P is substantially greater than Q.

8. The array of claim 6 wherein P is substantially less than Q.

9. The array of claim 5 in which said first spacing and said second spacing are equal, further including a plurality of electrical field probes mounted to at least one of said top and said bottom plates, one each of said probes being disposed adjacent each of said slots, the probes associated with adjacent slots in a row of slots being disposed on opposite sides of their respective slots.

10. The array of claim 5 wherein said first spacing and said second spacing are equal, further including a plurality of magnetic coupling loops mounted to said top plate and extending into the cavity, said magnetic coupling loops being disposed across said slots, at least one such coupling loop for each of said slots, said loops being disposed at an angle with respect to the longitudinal axes of their respective slots, the angle each loop makes with respect to its slot for each row of slots being opposite in sign to the angle each adjacent loop in that row makes with its slot.

11. A flat plate array, comprising:

a top plate;

a bottom plate; and a plurality of side walls including first and second sidewalls operatively connected to said top plate and said bottom plate so as to define a cavity therebetween, said first side wall having a first predetermined number Q of slots disposed therein to excite an electromagnetic wave mode to propagate perpendicularly with respect to the first side wall across the cavity, said second side wall having a second predetermined number of slots P therein to excite an electromagnetic wave mode to propagate perpendicularly with respect to the second side wall across the cavity, the first and second walls being disposed such that their respective electromagnetic wave modes are orthogonal, said top plate having a first set of radiating slots through it, the slots of said first set being parallel to one another and arranged in P−1 rows of alternatingly staggered parallel radiating slots and having Q columns of colinear radiating slots, and a second set of radiating slots, the slots of said second set being arranged in Q−1 columns of alternatingly staggered parallel slots and P rows of colinear radiating slots, said P rows and Q columns having a longitudinal axis perpendicular to one another, the longitudinal axes of said respective slot sets being perpendicular to one another.

12. An antenna array, comprising:

a top plate;

a bottom plate generally parallel to the top plate;

a first set of oppositely opposed side walls formed by waveguide caivites, each of said opposed side walls having a first predetermined number of slots disposed therein to excite an electromagnetic wave mode to propagate between the first set of opposed side walls;

a second set of oppositely opposed side walls formed by waveguide cavities, each of the opposed side walls of the second set having a second predetermined number of slots disposed therein to excite an eletromagnetic wave mode to propagate between the second set of opposed side walls, said first and second sets of opposed side walls being operatively connected to said top and bottom plate so as to define a cavity therebetween;

said top plate having a plurality of slots formed in it, said slots being arranged in a plurality of generally parallel rows having longitudinal axes in a first direction, and a plurality of columns having longitudinal axes perpendicular to the longitudinal axes of said rows, the slots of said rows defining a plurality of slot pairs having a first distance between them, respective ones of said slot pairs being separated by a second distance; the slots of said columns defining a plurality of slot pairs having a first distance between them, respective ones of said slot pairs being separated by a second distance; and means for perturbing the electrical field in said cavity, said rows of slots being disposed so as to couple only with the electromagnetic wave mode associated with the first set of side walls and the columns of slots being disposed as as to couple only with the electromagnetic wave mode associated with the second set of side walls.

13. The antenna of claim 12 in which said first distance is different from said second distance and said means for perturbing said field comprises arranging said slots so that the axes of said rows intersects the axes of said columns perpendicularly outside all slots along said second distance.

14. The antenna of claim 12 in which said distances are equal, said means for perturbing the electrical field comprises a plurality of probes mounted to one of said top and said bottom plates, one each of said probes being disposed adjacent each of said slots, the probes associated with adjacent slots in a row of slots being disposed on opposite sides of their respective slots.

15. The antenna of claim 12 in which said means for perturbing the electric field comprises a plurality of magnetic loops mounted to said top plate and extending into the cavity, one each of said loops disposed across each of said slots, said loops being disposed at an angle with respect to the longitudinal axes of their respective slots, the angle each loop makes with respect to its slot for each row of slots being opposite in sign to the angle each adjacent loop in that row makes with its slot.

16. The antenna of claim 12 wherein the number of slots in one set of said side walls correspond to the number of columns in said top plate and the number of slots in the other set of said side walls correspond to the number of rows in said top plate.

17. The antenna of claim 16 wherein the first predetermined number is P and the second predetermined number is Q, and said slots are arranged in P rows and Q columns, P and Q having different integer values.

* * * * *